US007591463B2

(12) United States Patent
An

(10) Patent No.: US 7,591,463 B2
(45) Date of Patent: Sep. 22, 2009

(54) MEDIA SUPPORT APPARATUS FOR MEDIA CASSETTE OF AUTOMATIC MEDIA DISPENSER

(75) Inventor: Joong-Ho An, Pyeongtaek (KR)

(73) Assignee: LG N-Sys Inc., Seoul (KR)

( * ) Notice: Subject to any disclaimer, the term of this patent is extended or adjusted under 35 U.S.C. 154(b) by 686 days.

(21) Appl. No.: 11/023,469

(22) Filed: Dec. 29, 2004

(65) Prior Publication Data

US 2005/0184444 A1 Aug. 25, 2005

(30) Foreign Application Priority Data

Dec. 31, 2003 (KR) ..... 10-2003-0101536

(51) Int. Cl.

| | |
|---|---|
| ***B65H 1/10*** | (2006.01) |
| ***B65H 1/12*** | (2006.01) |
| ***B65H 1/26*** | (2006.01) |
| ***B65H 3/54*** | (2006.01) |
| ***G03G 15/00*** | (2006.01) |

(52) U.S. Cl. ..... 271/160; 271/157; 271/170; 271/171; 271/223; 271/164; 347/104; 399/393; 399/405

(58) Field of Classification Search ..... 271/10.03, 271/157, 171, 223, 160, 170, 164; 347/104; 399/393, 405

See application file for complete search history.

(56) References Cited

U.S. PATENT DOCUMENTS

| | | | | |
|---|---|---|---|---|
| 4,704,061 | A | 11/1987 | Peebles | |
| 5,163,670 | A * | 11/1992 | Sellers et al. | 271/157 |
| 6,419,410 | B1 * | 7/2002 | Osmus et al. | 400/624 |
| 6,926,269 | B2 * | 8/2005 | Ishikuro | 271/171 |
| 6,935,629 | B2 * | 8/2005 | Asada | 271/171 |

FOREIGN PATENT DOCUMENTS

JP 09-315596 A 12/1997

* cited by examiner

*Primary Examiner*—Gene Crawford
*Assistant Examiner*—Rakesh Kumar
(74) *Attorney, Agent, or Firm*—Birch, Stewart, Kolasch & Birch, LLP

(57) ABSTRACT

A media support apparatus for a media cassette of an automatic media dispenser includes a base plate having a guide piece which is provided with a guide slot. A link mechanism has at least one connection pin, which is moved along the guide slot, and two connection link plates, the height of which, relative to the base plate, can be adjusted. A media seat is seated on each connection link plate. The horizontal spacing between the media seats can be adjusted. The apparatus is advantageous in that a single media cassette can be adapted to supply media of various sizes.

12 Claims, 7 Drawing Sheets

MEDIA SUPPORT APPARATUS FOR MEDIA CASSETTE OF AUTOMATIC MEDIA DISPENSER

This application claims the priority benefit of Patent Application No. 10-2003-0101536 filed on Dec. 31, 2003 in Republic of Korea, which is hereby incorporated by reference.

BACKGROUND OF THE INVENTION

1. Field of the Invention

The present invention relates to a media cassette of an automatic media dispenser. More particularly, the present invention relates to a media support apparatus of a media cassette with an adjustable height and width to accommodate various sizes of media so that the media, stacked in the media cassette, can be supported more accurately.

2. Description of the Related Art

As used herein, the term "media" refers to sheets of material, such as bank notes, checks, tickets, and certificates. The term "media dispenser" refers to an apparatus which automatically supplies such media according to a customer's demand.

FIG. 12 shows a media cassette and a structure for drawing media out of the media cassette, which are employed in a related art automatic media dispenser. A media cassette 1 is installed in the automatic media dispenser. Herein, the media cassette 1 may be either integrated with, or separately formed from, the automatic media dispenser.

Media m are arranged in a stack in the media cassette 1. In the media cassette 1, the media m are pushed toward a discharge port by a push plate 3, so that they are located in tight contact with each other. The push plate 3 is supported by a spring 5 so as to push the media. The spring 5 provides an elastic force which enables the push plate 3 to push the media.

Each sheet of the media, pushed toward the discharge port by the push plate 3, comes into tight contact with a pickup roller 7 before passing through the discharge port. The pickup roller 7 is located at one end of the media cassette 1, comes into contact with and separates each sheet of the media in the media cassette 1, and then moves the separated sheet out of the media cassette 1. The pickup roller 7 may be formed either integrally with the media cassette 1, or separately from the media cassette 1 in the automatic media dispenser.

A feed roller 9 and a contra-roller 10 are disposed close to and opposed to each other, so as to promote separation of a stacked sheet of the media from another sheet and transfer the single separated sheet. That is, the media are separated and transferred one sheet at a time by the feed roller 9 and the contra-roller 10 while each sheet passes through a gap between the feed roller 9 and the contra-roller 10 rotating in the same direction.

Each sheet of the media, having passed through the gap between the feed roller 9 and the contra-roller 10, is transferred by a feed roller or a belt provided at a delivery module (not shown).

However, the aforementioned related art has problems. The media m, which are stacked in the media cassette 1, have various sizes. Nevertheless, the media cassette 1 cannot change the way it supports or guides the media m based on the media's size and thus cannot be used for media m of various sizes. Therefore, different media cassettes 1 must be provided to accommodate respective sizes of the media m. Having many different sized media cassettes 1 to accommodate different sizes of media is expensive to the manufacturer in design costs and inventory space, and expensive to the media dispenser purchaser since several different media cassettes may need to be purchased.

SUMMARY OF THE INVENTION

Accordingly, the present invention is conceived to solve the one or more of the drawbacks in the related art. An object of the present invention is to provide a media support apparatus adapted to support and guide media, which are used in an automatic media dispenser.

According to an aspect of the present invention for achieving these and other objects, there is provided a media support apparatus for a media cassette of an automatic media dispenser, comprising: a base plate having a guide piece which is provided with a guide slot; a link mechanism having at least one connection pin, which is moved along the guide slot, and a connection link plate, the level of which can be adjusted; at least two media seats which are horizontally seated on the connection link plate of the connection mechanism with a predetermined spacing and are elongated along a direction; and a support mechanism for retaining the link mechanism at a predetermined level.

A pair of guide pieces is formed on each of the opposite ends of the link mechanism.

The link mechanism includes: a connection link plate having an upper surface on which the media seat is seated; an elevating leg rotatably connected to each of the opposite ends of the connection link plate via a connection pin; and a connection lever connected to each end of both of the elevating legs via a connection pin, which is positioned in the guide slot.

The support mechanism includes: a support table which is movably positioned on the base plate and has a slant portion with a predetermined slant; a connection support shaft which penetrates the connection link in a traverse direction and is supported on the slant portion to retain the link mechanism; and a resilient member which provides a resilient force so that the connection support shaft is forced against the slant portion.

The support table is positioned between the link mechanisms.

The slant portion of the support table has a number of seating recesses formed parallel to a direction along which the connection support shaft extends, in order to seat the connection support shaft therein.

The link mechanism is positioned on each of the opposite ends of the support table and the connection support shaft is connected to the elevating leg of the opposite link mechanisms at the same time.

The support table has a pair of long movement apertures, through which coupling screws are coupled on the base plate, in order to position the support table.

The media seat is adapted to move in a direction that traverses the connection link plate, the connection link plate has a serration formed along a direction that traverses the media seat, and the media seat is provided with a holder having a deformable elastic manipulation piece, which is provided with a coupling serration that can be selectively coupled with the serration.

The media seat is provided with guides in locations corresponding to those of leading and tailing ends of the connection link plate, so that the media seat is guided to move in a direction that traverses the connection link plate.

The link mechanism includes: a connection link plate having an upper surface on which the media seat is seated; an elevating leg rotatably connected to the connection link plate via a connection pin; and a connection pin which is positioned on an end of the elevating leg and the opposite ends of which are positioned in the guide slot.

The support mechanism includes: a support table which is movably positioned on the base plate and has a slant portion with a predetermined slant; a support end which is integrated to the base plate and has a number of hook steps, which have different levels; a connection support shaft which penetrates the connection link in a traverse direction and is supported on the slant portion to retain the link mechanism; and a resilient member which provides a resilient force so that the connection support shaft is forced against the slant portion.

The support table is positioned on each of the opposite ends of the link mechanism.

The slant portion of the support table has a number of seating recesses formed parallel to a direction along which the connection support shaft extends, in order to seat the connection support shaft therein.

The connection support shaft is connected to each elevating leg of both of the link mechanisms at the same time and the opposite ends of the connection support shaft are supported on the support table.

The support table has a pair of long movement apertures, through which coupling screws are coupled on the base plate, in order to position the support table.

The media seat is adapted to move in a direction that traverses the connection link plate, the connection link plate has a serration which has a sectional shape of a right triangle and is formed along a direction that traverses the media seat and the media seat is provided with a holder having a deformable elastic manipulation piece, which is provided with a coupling serration that can be selectively coupled with the serration and has a sectional shape of a right triangle.

The present invention, configured as above, is advantageous in that a single media cassette can be used for media of various sizes and it is possible to adjust the height of a feature that supports the ends of the stacked media.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
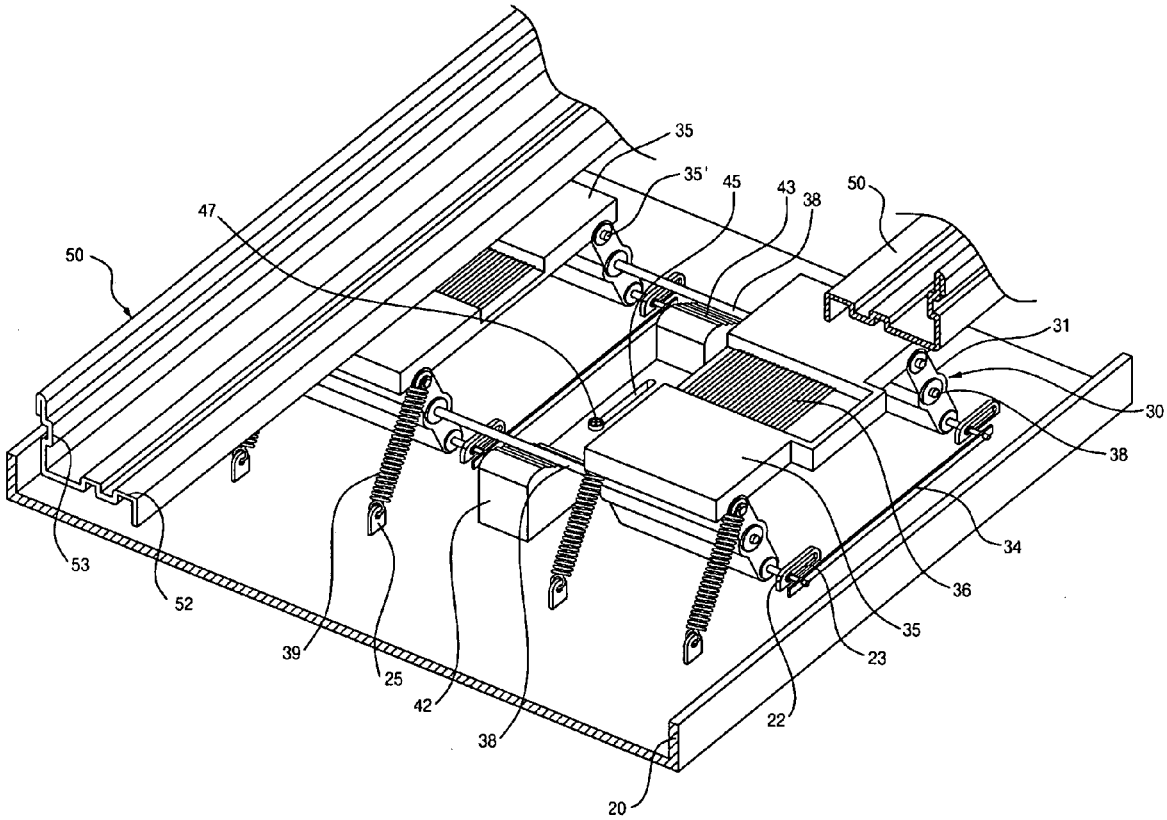
FIG. 1 is a perspective view showing the configuration of one embodiment of a media support apparatus for a media cassette according to the present invention.

Hereinafter, a preferred embodiment of a media support apparatus for a media cassette of an automatic media dispenser according to the present invention will be described with reference to the accompanying drawings. In the following description and drawings, the same reference numerals are used to designate the same or similar components, and so repetition of the description on the same or similar components will be omitted.

Figure 2:
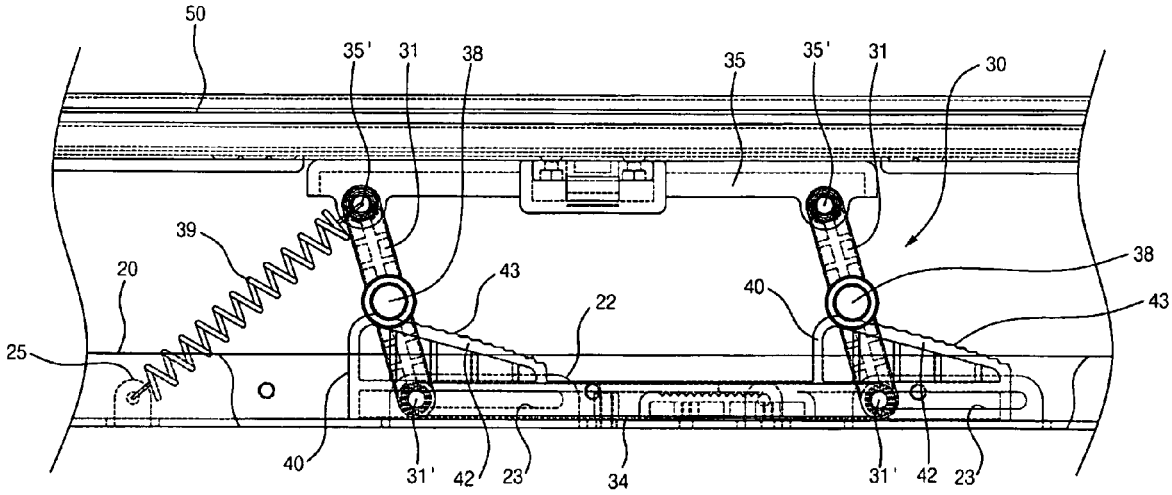
FIG. 2 is a side view, partially broken, showing the configuration of one embodiment of a media support apparatus for a media cassette according to the present invention.
Figure 3:
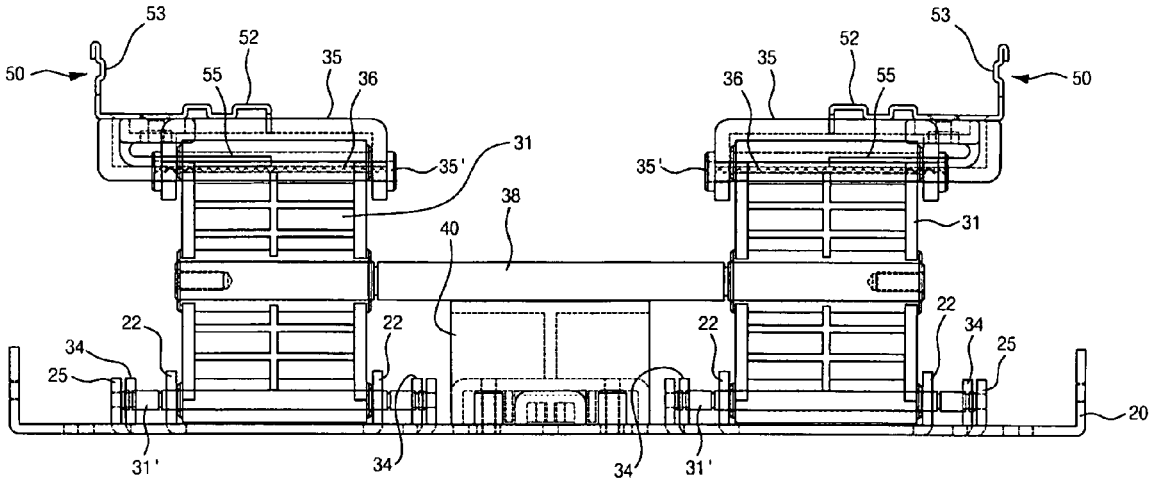
FIG. 3 is a front view showing the configuration of an embodiment of the present invention.
Figure 4:
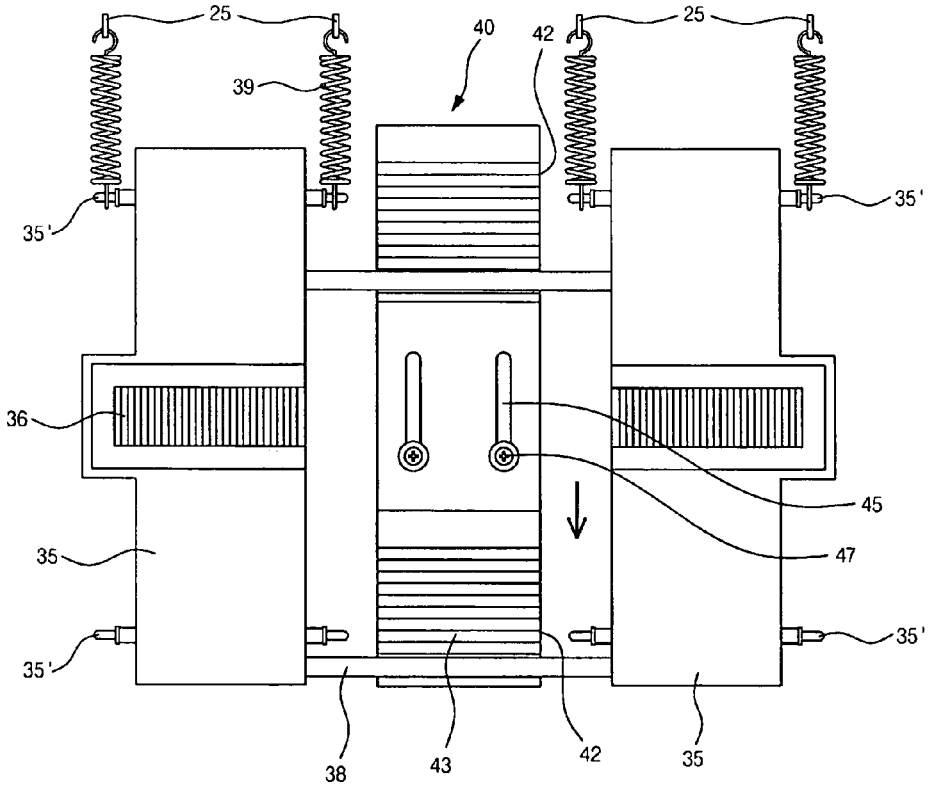
FIG. 4 is a top view showing features of an embodiment of the present invention.

FIG. 1 is a perspective view showing the configuration of a preferred embodiment of a media support apparatus for a media cassette according to the present invention; FIG. 2 is a side view showing one embodiment of a media support apparatus for a media cassette according to the present invention; FIG. 3 is a front view showing the embodiment of the present invention; and FIG. 4 is a top view showing features of the embodiment of the present invention.

As shown in the drawings, a base plate 20 is provided with guide pieces 22. The base plate 20 may be integrally form with the body of the media cassette or may be a separate plate which is fastened within the body of the media cassette. The present embodiment includes four pairs of guide pieces 22 (i.e., a total of eight). The guide pieces 22 protrude from the base plate 20. The guide pieces 22 are provided with elongated guide slots 23.

The base plate 20 is also provided with holding pieces 25. The holding pieces 25 also protrude from a side of the base plate 20. Ends of resilient members 39, which will be described below, are hooked on the holding pieces 25.

A pair of link mechanisms 30 is positioned on the left and right sides of the base plate 20 with a predetermined spacing to adjust the level at which the media are supported. The link mechanisms 30 are provided with elevating legs 31. As shown in FIG. 3, the elevating legs 31 are rectangular plates and have a width which is slightly smaller than the spacing between the pair of guide pieces 22. Connection pins 31' extend through the lower ends of the elevating legs 31 and also through the guide slots 23 of the guide pieces 22. In the present embodiment, two elevating legs 31 are assigned to each of media seats 50, which will be described below (i.e., a total of four).

The connection pins 31' are connected with connection levers 34 from outside of the guide pieces 22. Each of the connection levers 34 is connected with two elevating legs 31 and one connection pin 31', which belong to a media seat 50, to interlock and drive the elevating legs 31. As shown in FIG. 3, a total of four connection levers 34 may be positioned on the opposite ends of the elevating legs 31 for the operational stability of the link mechanisms 30.

The elevating legs 31 are provided with connection link plates 35, which are connected on their upper ends by connection pins 35'. The connection link plates 35 are of a rectangular shape having a predetermined area, as shown in FIG. 4. Each of the connection link plates 35 connects two elevating legs 31 with each other.

The connection link plates 35 are provided with serrations 36 on their upper surfaces, as shown in FIGS. 3 and 4. Each of the serrations 36 traverses the upper surface of each connection link plate 35, on which it is formed, and extends toward the other connection link plate 35 until it reaches the end of the connection link plate 35.

Connection support shafts 38 extend through approximately middle portions of the elevating legs 31 in a traverse direction. The connection support shafts 38 connect corresponding elevating legs 31 of the pair of link mechanisms 30, which are positioned with a predetermined spacing. Accordingly, two connection support shafts 38 are used to level the connection link plates 35 which are provided on both of the link mechanisms 30.

A resilient member 39 connects one end of one of the connection pins 35' with one of the holding pieces 25. Another resilient member 39 connects the other end of the connection pin 35' with another holding piece 25. The resilient members 39 provide a resilient force so that the connection support shafts 38 are forced into seating recesses 43 of a support table 40 (described below) and seated therein. Although only one connection pin 35', which is positioned on the left-hand side of the connection link plate 35 in FIG. 2, has a resilient member 39 in the present embodiment, the other connection pin 35', which is positioned on the right-hand side in FIG. 2, may be connected to an end of another resilient member 39 and the other end of the resilient member 39 may be connected to a separate holding piece 25.

Support tables 40 are positioned on the base plate 20 between the link mechanisms 30. The support tables 40 retain the link mechanisms 30, more particularly the connection link plates 35, so that they are positioned at a specific level. To this end, the support tables 40 have slant portions 42. The slant portions 42 are positioned in locations corresponding to those of the connection support shafts 38 to support them. The slant portions 42 have a number of seating recesses 43 formed along the longitudinal direction of the connection support shafts 38 to support them more securely. As the connection support shafts 38 can be positioned in any of the seating recesses 43, they can be supported at different levels.

The support table 40 has a plurality of movement apertures 45 formed along its longitudinal direction and parallel to one another, through which coupling screws 47 are coupled on the base plate 20. Accordingly, the range of levels at which the connection support shafts 38 may be positioned and supported by the support table 40, depends on the location of the coupling screws 47 within the movement apertures 45.

Each of the connection link plates 35 is provided with a media seat or guide 50 on its upper surface. The media seats 50 can be moved along a direction which is perpendicular to the longitudinal direction of the connection link plates 35, and extend along the longitudinal direction of the media cassette. The media seats 50 are much longer than the connection link plates 35 and the length of the media seats 50 determines the number of media that can be stacked in the media cassette.

The media seats 50 are supported on the upper surfaces of the connection link plates 35, as shown in FIG. 3 and the media are stacked with side edges resting on the upper surfaces of the media seats 50 in an upright position. The media seats 50 have side walls 53, which extend along their longitudinal sides and are perpendicular to their bottom surfaces 52. The side walls 53 are opposite to each other and guide the corresponding opposite ends of the upright media.

A feature for selectively positioning the media seats 50 along the traverse direction of the connection link plates 35 will now be explained. The media seats 50 have holders 55 in locations corresponding to those of the serrations 36 of the connection link plates 35.

Figure 5:
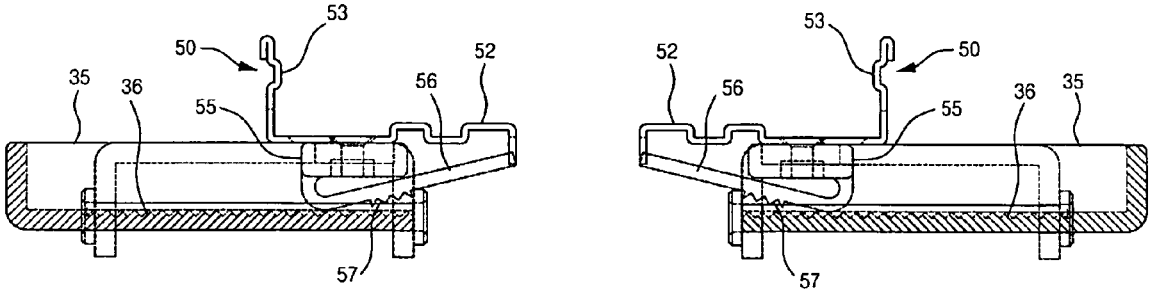
FIG. 5 is a front sectional view showing a feature for positioning a media seat, which constitutes an embodiment of the present invention.
Figure 6:
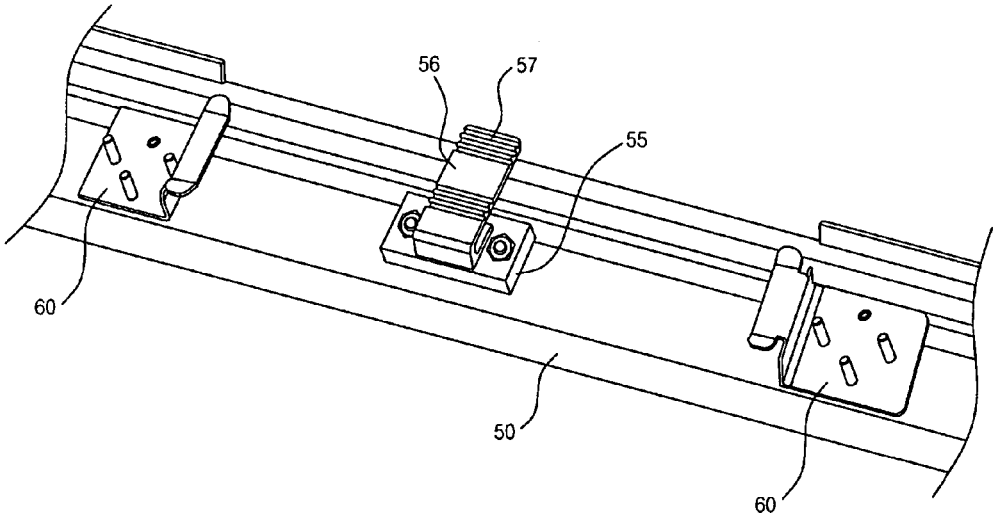
FIG. 6 is a partial perspective view showing the configuration of a media seat, from below, which constitutes an embodiment of the present invention.

The holders 55 are fastened on the bottom surfaces of the media seats 50, as shown in FIGS. 5 and 6. Each of the holders 55 is made of molded material and has a long manipulation piece 56 on its end. The manipulation pieces 56 can undergo elastic deformation due to their shape and material. The manipulation pieces 56 have leading ends which extend toward each other, in other words, toward each side of the media seats 50. The manipulation pieces 56 have coupling serrations 57 formed on their surfaces, which correspond to the serrations 36 on the upper surfaces of the connection link plates 35. The coupling serrations 57 are coupled with the serrations 36 to prevent the media seats 50 from moving in a direction which is perpendicular to their longitudinal direction.

Meanwhile, the media seats 50 are provided with guides 60 which guide them to move in a direction which is perpendicular to the connection link plates 35. The guides 60 are positioned on the lower surfaces of the media seats 50 in locations corresponding to the leading and trailing ends of the connection link plates 35.

Hereinafter, the operation of a media support apparatus for a media cassette of an automatic media dispenser according to the present invention configured as above will be described in detail. The present invention seeks to support media of various sizes using a single media cassette. Accordingly, the media seats 50 are adapted to change their positions according to the horizontal (e.g. width) and vertical (e.g. height) sizes of the media.

The level or height of the media seats 50 is adjusted by the link mechanisms 30 interacting with the support tables 40. This adjustment is based on the vertical size or height of the media to be dispensed. In addition, the spacing between the media seats 50 is adjusted as the media seats 50 are moved on the connection link plates 35 along a direction perpendicular to their longitudinal direction. This adjustment is based on the horizontal size of width of the media to be dispensed.

The height of the media seats 50 is adjusted as follows: FIG. 2 shows a state wherein the media seats 50 are positioned relatively high. In this case, the connection support shafts 38 are seated in seating recesses 43, which have relatively higher positions, than the other seating recesses 43 of the slant portions 42 of the support table 40 and the level of the connection link plates 35 of the link mechanisms 30 is determined accordingly. The resilient members 39 force and hold the connection support shafts 38 into the selected seating recesses 43 to prevent the link mechanisms 30 from moving arbitrarily.

Figure 7A:
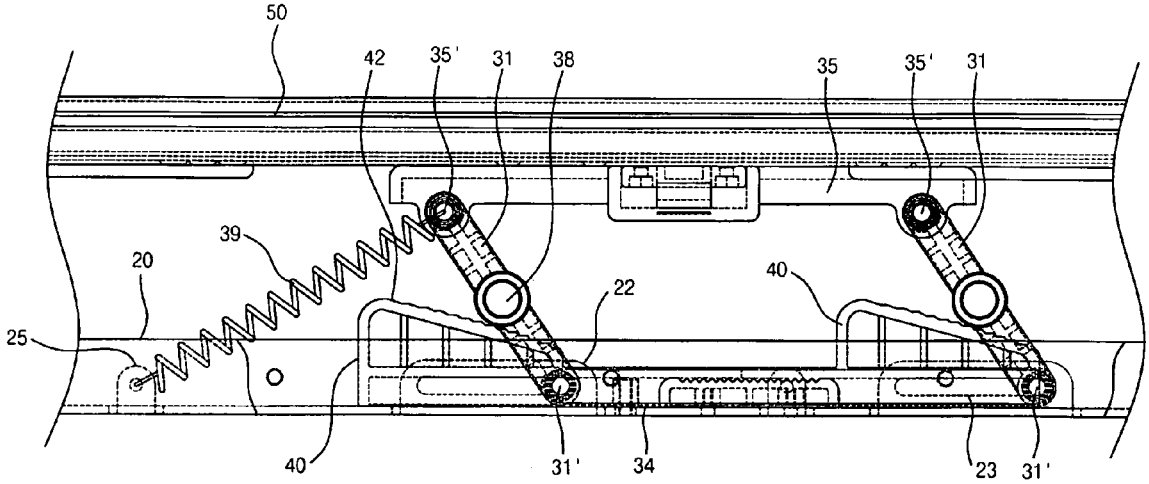
FIG. 7*a* shows the level adjustment feature of a media seat, during service, of an embodiment of the present invention.

Modification of the level of the media seats 50 can be performed by adjusting the link mechanisms 30. Specifically, the connection pins 31' are moved from forward ends of the guide slots 23 of the guide pieces 22 to rearward ends, in other words, from a state shown in FIG. 2 to that shown in FIG. 7*a*.

As the connection pins 31' are moved along the guide slots 23, the connection levers 34 accompany them and the lower ends of the elevating legs 31 are transferred to the other ends of the guide slots 23 together with the connection pins 31'. The upper ends of the elevating legs 31 are then lowered, and so are the connection link plates 35, which are connected to the upper ends of the elevating legs 31. This also lowers the media seats 50 automatically, which are positioned on the connection link plates 35. The connection support shafts 38 are seated in relatively lower positions from among the seating recesses 43 of the slant portions 42.

Since the two link mechanisms 30 are connected to each other by the connection support shafts 38, both of the connection link plates 35 are leveled with each other, and so are both of the media seats 50. The media seats 50 maintain their level and are not moved by the resilient members 39, as the connection support shafts 38 are supported by the seating recesses 43 of the slant portions 42 of the support table 40.

Figure 7B:
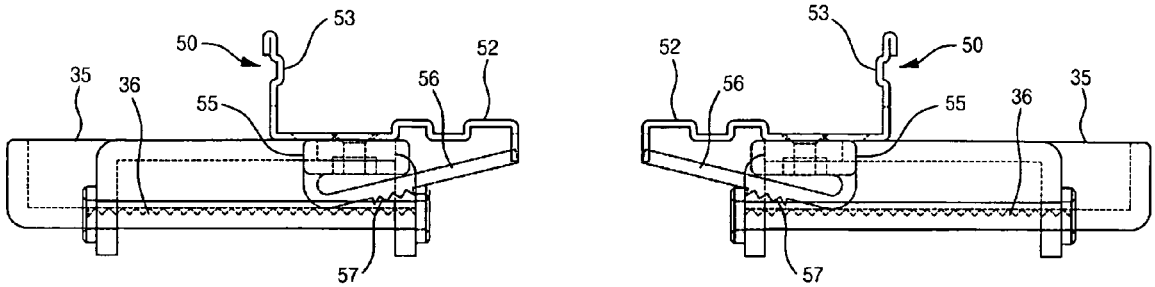
FIG. 7*b* shows the lateral movement adjustment feature of a media seat, during service, of an embodiment of the present invention.

The spacing between the two media seats 50 is adjusted as follows: as shown in FIG. 7*b*, the manipulation pieces 56 of the holders 55 are lifted so that the coupling serrations 57 of the manipulation pieces 56 are separated from the serrations 36 of the connection link plates 35.

Then, the media seats 50 can be guided and moved freely by the guides 60. In this state, the two media seats 50 can be positioned so that they are spaced from each other as desired. When the media seats 50 are positioned relative to the connection link plates 35, the manipulation pieces 56 are released and naturally, resiliently returned to their original open status. After the manipulation pieces 56 resiliently open, the coupling serrations 57 are coupled with the serrations 36 to prevent the media seats 50 from moving.

Next, it will be explained how to change the range of level adjustment of the media seats 50 by moving the support table 40. The coupling screws 47 are slightly loosened to move the support table 40. The support table 40 is then moved in a direction as indicated by an arrow in FIG. 4. Such a movement is enabled by the movement apertures 45 formed on the support table 40, through which the coupling screws 47 penetrate.

Figure 7C:
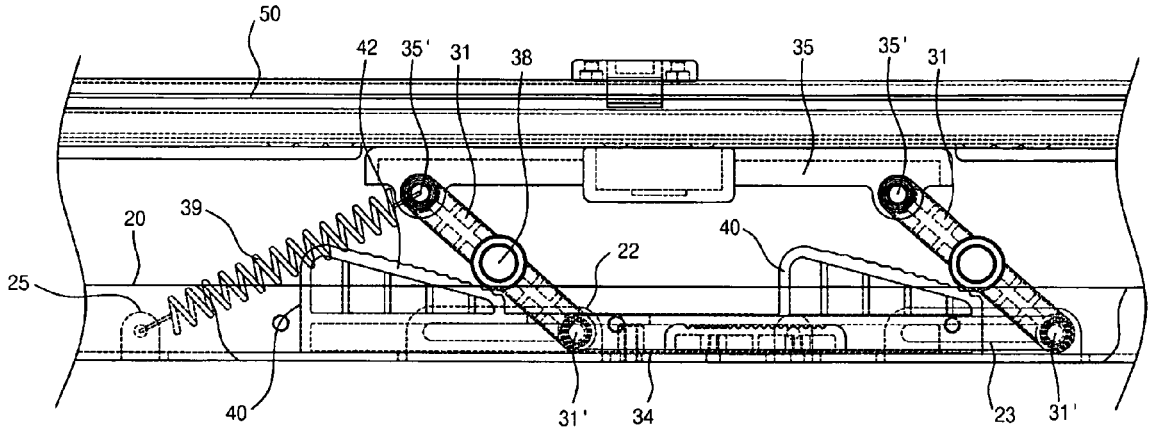
FIG. 7*c* shows the movement of a supporting table for the purpose of setting the level of a link mechanism, during service, of an embodiment of the present invention.

After the support table 40 is moved as desired, the coupling screws 47 are tightened again to hold the support table 40 on the base plate 20. Such a state, wherein the support table 40 is moved, is shown in FIG. 7*c*. As the support table 40 is moved as seen in the drawing, the range of height adjustment of the media seats 50 is changed by the link mechanisms 30.

Figure 8:
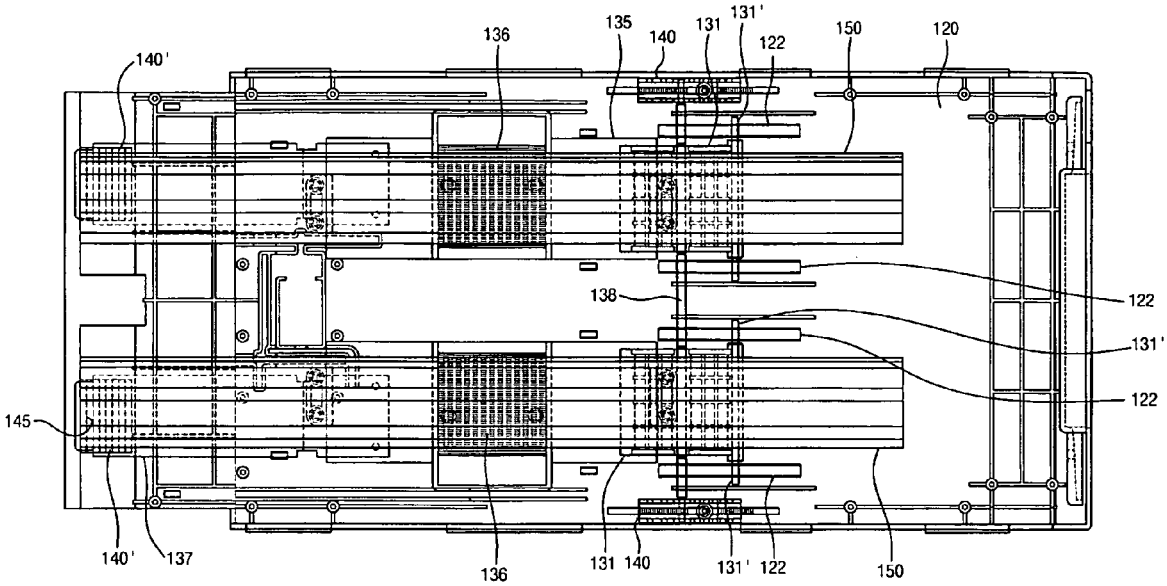
FIG. 8 is a top view showing the configuration of another embodiment of the present invention.
Figure 9:
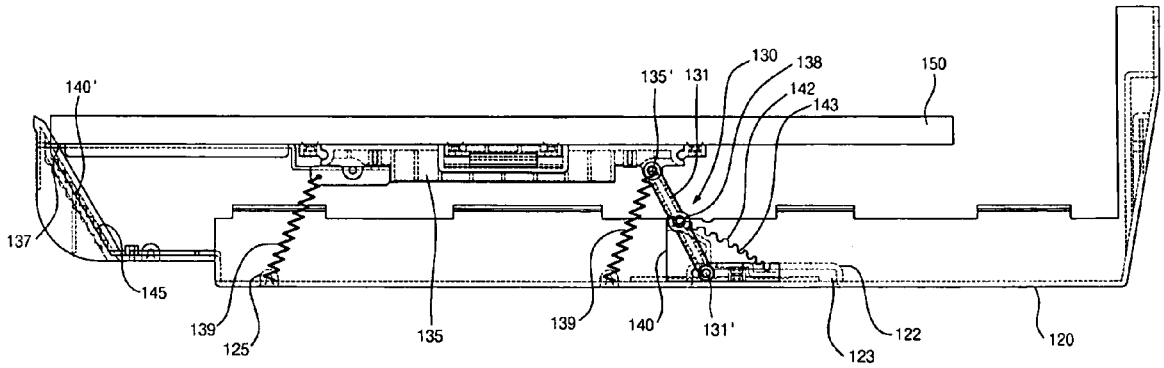
FIG. 9 is a lateral view showing the configuration of another embodiment of the present invention.
Figure 10:
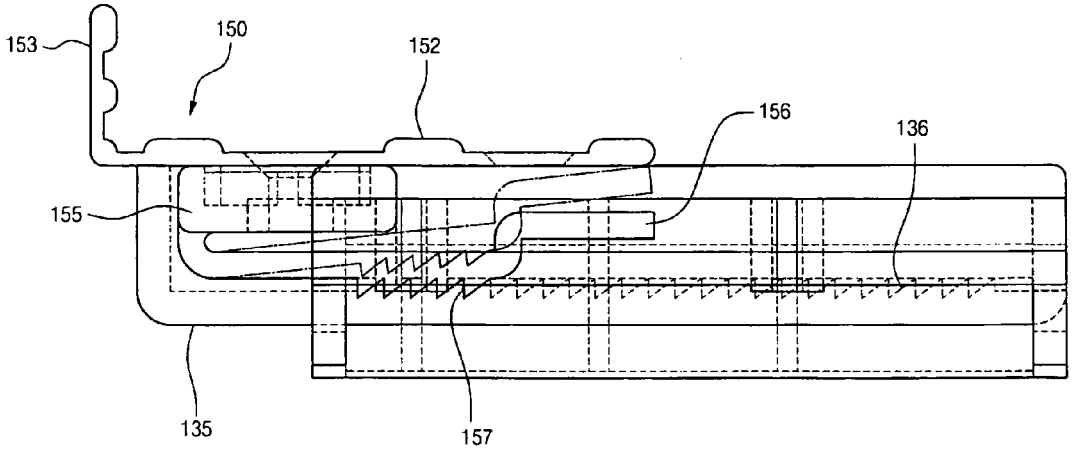
FIG. 10 is a lateral view showing features of another embodiment of the present invention.
Figure 11:
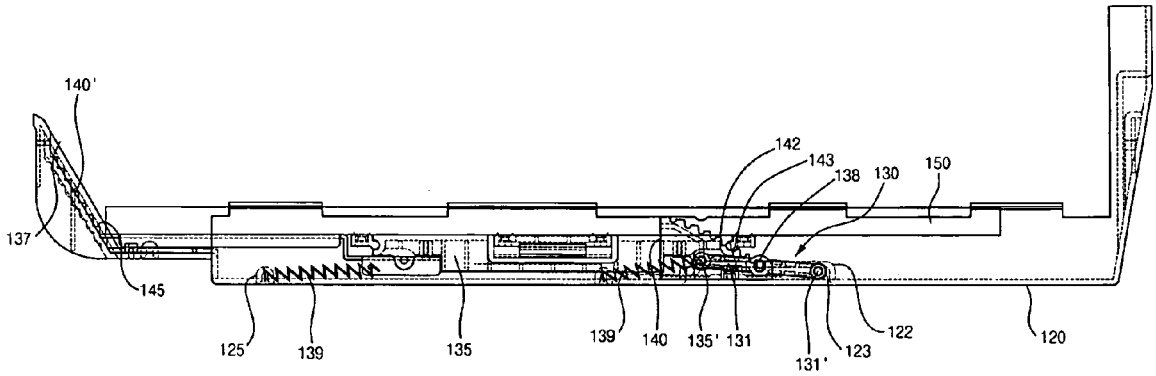
FIG. 11 shows the operation of the embodiment shown in FIG. 8.
Figure 12:
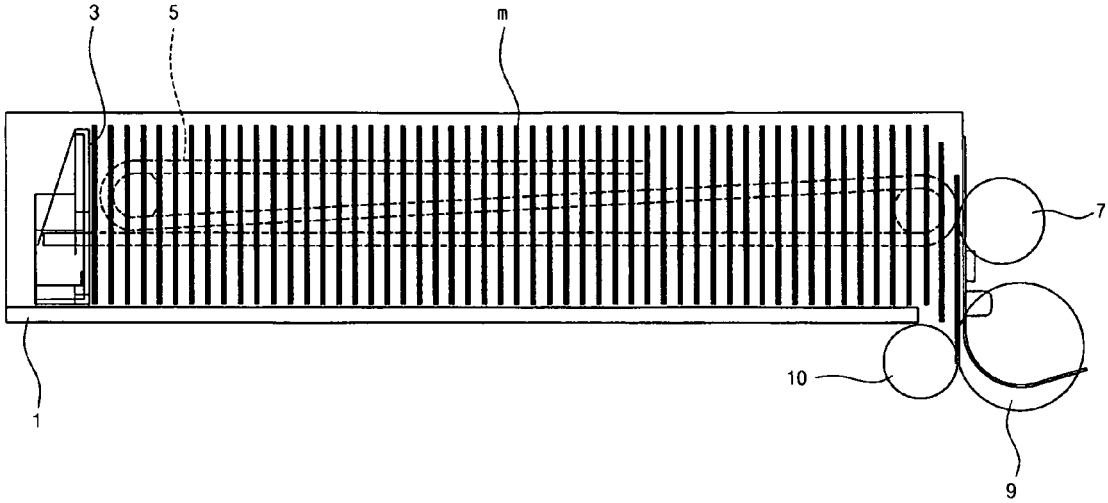
Fig. 12 Related Art
FIG. 12 is a sectional view showing a media cassette, which is used in a related art automatic media dispenser, and a feature for separating the media from the cassette.

FIGS. 8 to 10 show another embodiment of the present invention. In this embodiment, components the same as in the previous embodiment are given the same respective reference numerals, greater by a value of 100, and repeated description thereof will be omitted.

A base plate 120 is provided with guide pieces 122. The present embodiment includes two pairs of guide pieces 122 (i.e., a total of four). The guide pieces 122 protrude from the base plate 120. The guide pieces 122 are provided with guide slots 123, which traverse them and extend along the longitudinal direction thereof.

The base plate 120 is also provided with holding pieces 125. The holding pieces 125 also protrude from a side of the base plate 120. Ends of resilient members 139, which will be described below, are hooked on the holding pieces 125. The number of the holding pieces 125 corresponds to that of the resilient members 139. The present embodiment includes a total of eight holding pieces 125.

A pair of link mechanisms 130 is positioned on the left and right sides of the base plate 120 with a predetermined spacing to adjust the level at which the media are supported. The link mechanisms 130 are provided with elevating legs 131. The elevating legs 131 are rectangular plates and have a width which is slightly smaller than the spacing between the pair of guide pieces 122.

Connection pins 131' extends through the lower ends of the elevating legs 131 and also through the guide slots 123 of the guide pieces 122. In the present embodiment, one elevating leg 131 is assigned to each media seat 150, which will be described below (i.e., a total of two).

The upper ends of the elevating legs 131 are connected with connection link plates 135 via connection pins 135'. The connection link plates 135 are of a rectangular shape having a predetermined area and are positioned horizontally or parallel relative to the base plate 120. To this end, the connection link plates 135 have hook ends 137 extending from their ends along their longitudinal direction.

The hook ends 137 may be integrated to the connection link plates 135 or may be coupled to them as separate components. The hook ends 137 are preferably made of metal for enhanced strength when, for example, the connection link plates 135 are expected to be subject to a large load. Sides of the hook ends 137 are selectively hooked on hook steps 145 of support ends 140', which will be described below.

The connection link plates 135 are provided with serrations 136 on their upper surfaces. Each of the serrations 136 traverses the upper surface of the corresponding connection link plate 135 on which it is formed, and extends toward the other connection link plate 135 until it reaches the end of its own corresponding connection link plate 135. In the illustrated embodiment, the serrations 136 have a sectional shape of a right triangle, however other shapes are possible.

A connection support shaft 138 extend through portions in the approximate middle of the elevating legs 131 in a traverse direction. The connection support shaft 138 connects corresponding elevating legs 131 of the pair of link mechanisms 130, which are positioned with a predetermined spacing. The connection support shaft 138 is used to level the connection link plates 135, which are provided on both of the link mechanisms 130.

Resilient members 139 are provided. One end of a resilient member is hooked to one of the connection pins 135' and the other end is hooked to one of the holding pieces 125. Preferably, a total of four resilient members 139 are provided per one connection link plate 135. In particular, the resilient members 139 are connected closer to the opposite ends of the connection link plates 135 with a predetermined spacing, respectively. Preferably, two of the four resilient members 139 have their ends connected to the opposite ends of the connection pins 135', respectively, and the other two of resilient members 139 have ends connected closer to the hook ends 137, respectively. The resilient members 139 provide a resilient force so that the connection support shafts 138 are forced against seating recesses 143 of a ramp or support table 140 (explained below), as well as against hook steps 145 of support ends 140', and are seated therein.

Support tables 140 are positioned on the base plate 120 outside of the link mechanisms 130. The support tables 140 retain the link mechanisms 130, more particularly the connection link plates 135, so that they are positioned at a specific level. To this end, the support tables 140 have slant portions 142. The slant portions 142 are positioned in locations corresponding to the locations of the connection support shafts 138 to support them. The slant portions 142 have a number of seating recesses 143 formed along the longitudinal direction of the connection support shafts 138 to support them more securely. As the connection support shafts 138 can be positioned in any of the seating recesses 143, they can be supported at different heights.

The support table 140 can change its position, as in the previous embodiment. In other words, the support table 140 can be moved on the base plate 120 along the transfer direction of media and fixed to the base plate 120 at the desired position.

A support end 140' is provided at one end of the base plate 120 and replaces the second support table 140 (illustrated in the previous embodiment). The support end 140' is integrated on a side of the base plate 120 and is positioned at a level higher than that of the support table 140. The support end 140' directly supports the hook end 137, which has no elevating leg 131. Actually, the support end 140' is formed along an inner wall of an end of the media cassette. The support end 140' has hook steps 145, on which the hook ends 137 are actually hooked. The number of the hook ends 145 may correspond to the number of the seating recesses 143 of the support table 140.

Each of the connection link plates 135 is provided with a media seat 150 on its upper surface. The media seats 150 can be moved along a direction, which is perpendicular to the longitudinal direction of the connection link plates 135, and extend along the longitudinal direction of the media cassette. The media seats 150 are much longer than the connection link plates 135, and the length of the media seats 150 determines the number of media that can be stacked in the media cassette.

The media seats 150 are supported on the upper surfaces of the connection link plates 135 and side edges of the media are seated on the upper surfaces of the media seats 150 such that the media rest in an upright position. The media seats 150 have side walls 153, which extend along their longitudinal sides and are perpendicular to their bottom surfaces 152. The side walls 153 are opposite to each other and guide the respective ends of the upright stacked media.

In order to selectively move the media seats 150 along their traverse direction on the connection link plates 135, the media seats 150 have holders 155 in locations corresponding to the serrations 136 of the connection link plates 135. The holders 155 are fastened on the bottom surfaces of the media seats 150. Each of the holders 155 is made of molded material and has a long manipulation piece 156 on its end. The manipulation pieces 156 can undergo elastic deformation due to their shape and material. The manipulation pieces 156 have leading ends which extend toward each other, in other words, toward each respective side of the media seats 150. The manipulation pieces 156 have coupling serrations 157 formed on their surfaces, which correspond to the serrations 136 on the upper surfaces of the connection link plates 135. The coupling serrations 157 are coupled with the serrations 136 to prevent the media seats 150 from moving in a direction which is perpendicular to their longitudinal direction. To this end, the coupling serrations 157 have a sectional shape of a right triangle. The right-angled surfaces of them face the serrations 136.

The media seats 150 are preferably provided with guides (not shown), which guide them to move perpendicularly to the connection link plates 135, as in the previous embodiment.

The operation of the present embodiment, configured as above, will now be explained in detail. For clarity, only characteristic features of the present embodiment will be described. The height of the media seats 150 is adjusted as follows: the media seats 150 have their connection support shafts 138 and hook ends 137 supported on the support table 140 and the support end 140', respectively. In order to adjust the height of the media seats 150, the seating recesses 143 and the hook steps 145, on which the connection support shafts 138 and the hook ends 137 are seated, respectively, are simply changed. To this end, the connection support shafts 138 are moved away from the slant portions 142 of the support table 140, i.e. out of the seating recesses 143. The movement of the connection support shafts 138 is accompanied by movement of the elevating legs 131. As a result, the connection pins 131' of the elevating legs 131 change their locations in the guide slots 123. The hook ends 137 should also be supported on different hook steps 145 to orient the media support table 150 horizontally.

The resilient members 139 can provide a resilient force so that the connection support shafts 138 and the hook ends 137 are continuously biased to be seated in the seating recesses 143 and the hook steps 145, respectively. As such, the media support table 150 does not change its height due to slight external forces, such as bumping or jarring of the media cassette. Rather, it takes a purposeful manual manipulation on the part of the user to change the height of the support table.

According to the present invention as described in detail above, the following advantages can be obtained. Since a single media cassette can be used for media of various sizes, it is possible to provide a highly compatible and adaptable media cassette. Further, two link mechanisms are interlocked to adjust the height of media seats based on the media's size. Therefore, the two media seats can be automatically and simultaneously leveled accurately and the media can be supported correctly. Furthermore, the media seats can be adjusted based not only on the height of the media to be dispensed, but also on the basis of the width of the media to be dispensed.

The scope of the present invention is not limited by the illustrated embodiments but defined by the appended claims. It will be apparent that those skilled in the art can make various modifications and changes within the scope of the invention defined by the claims.

What is claimed is:

1. A media cassette for an automatic media dispenser, comprising:

a media seat for supporting lower edges of media aligned in a stack in said media cassette; and an adjustment device for allowing a user to select and fix a height of said media seat from a bottom of said media cassette, so as to accommodate a size of media having a given dimension from its lower edge to its upper edge, wherein said media seat includes a first surface supporting side edges of the media at one end of the media and a second surface supporting side edges of the media at an opposite end of the media, and wherein said adjustment device includes:

a base plate forming said bottom of said media cassette, said base plate having a first guide piece provided with a first guide slot, a second guide piece provided with a second guide slot, a third guide piece provided with a third guide slot, and a fourth guide piece provided with a fourth guide slot;

a first link mechanism positioned between said first and second guide pieces, said first link mechanism having a first elevating leg rotatably connected to a first connection link plate proximate a first end of said first elevating leg, and rotatably connected to a first connection pin proximate a second end of said first elevating leg, wherein said first connection pin is moved along said first and second guide slots, and a height of said first connection link plate can be user adjusted relative to said base plate;

a second link mechanism positioned between said third and fourth guide pieces, said second link mechanism having a second elevating leg rotatably connected to a second connection link plate proximate a first end of said second elevating leg, and rotatably connected to a second connection pin proximate a second end of said second elevating leg, wherein said second connection pin is moved along said third and fourth guide slots, and a height of said second connection link plate can be user adjusted relative to said base plate; and a support mechanism for retaining said first and second link mechanisms, such that said first and second connection link plates remain at a user's adjusted height relative to said base plate.

2. The media cassette as claimed in claim 1, wherein said support mechanism includes:

a support table positioned on said base plate between said first and second link mechanisms, said support table having a slanted surface; and a connection support shaft connected to said first and second elevating legs and engaging said slanted surface of said support table.

3. The media cassette as claimed in claim 2, wherein said support mechanism further includes:

resilient members connected to said base plate, wherein said resilient members apply a biasing force tending to move said first ends of said first and second elevating legs toward said base plate such that said connection support shaft bears against said slanted surface of said support table.

4. A media cassette as claimed in claim 2, wherein said slanted surface of said support table has a number of seating recesses formed parallel to a direction along which said connection support shaft extends, in order to seat said connection support shaft therein.

5. A media cassette as claimed in claim 2, wherein said support table has at least one slot aperture, through which at least one coupling screw passes to connect said support table to said base plate, so that said support table can be attached to said base plate at a user adjustable position.

6. The media cassette as claimed in claim 2, wherein said support mechanism further includes:

a support end which is connected to, or integrated with, said base plate and has a number of hook steps, at different heights from said base plate; and at least one hook formed on an end of said first connection plate and said second connection plate, respectively, wherein said at least one hook of each of said first and second connection plates can be selectively engaged to one of the hook steps of the support end.

7. The media cassette as claimed in claim 6, wherein said support end is formed proximate an edge of said base plate and is formed as a ramp having a slanted surface extending away from said base plate.

8. A media cassette for an automatic media dispenser, comprising:

a media seat for supporting lower edges of media aligned in a stack in said media cassette; and an adjustment device for allowing a user to select and fix a height of said media seat from a bottom of said media cassette, so as to accommodate a size of media having a given dimension from its lower edge to its upper edge, wherein said adjustment device includes:

a base plate forming said bottom of said media cassette, said base plate having a first guide piece provided with a first guide slot, a second guide piece provided with a second guide slot, a third guide piece provided with a third guide slot, and a fourth guide piece provided with a fourth guide slot;

a first link mechanism positioned between said first and second guide pieces, said first link mechanism having a first elevating leg rotatably connected to a first connection link plate proximate a first end of said first elevating leg, and rotatably connected to a first connection pin proximate a second end of said first elevating leg, wherein said first connection pin is moved along said first and second guide slots;

a second link mechanism positioned between said third and fourth guide pieces, said second link mechanism having a second elevating leg rotatably connected to said first connection link plate proximate a first end of said second elevating leg, and rotatably connected to a second connection pin proximate a second end of said second elevating leg, wherein said second connection pin is moved along said third and fourth guide slots, and a height of said first connection link plate can be user adjusted relative to said base plate; and a first connection lever connecting said first connection pin to said second connection pin.

9. The media cassette as claimed in claim 8, wherein said media seat includes a first surface supporting side edges of the media at one end of the media and a second surface supporting side edges of the media at an opposite end of the media, and wherein said adjustment device further includes:

said base plate having a fifth guide piece provided with a fifth guide slot, a sixth guide piece provided with a sixth guide slot, a seventh guide piece provided with a seventh guide slot, and an eighth guide piece provided with an eighth guide slot;

a third link mechanism positioned between said fifth and sixth guide pieces, said third link mechanism having a third elevating leg rotatably connected to a second connection link plate proximate a first end of said third elevating leg, and rotatably connected to a third connection pin proximate a second end of said third elevating leg, wherein said third connection pin is moved along said fifth and sixth guide slots;

a fourth link mechanism positioned between said seventh and eighth guide pieces, said fourth link mechanism having a fourth elevating leg rotatably connected to said second connection link plate proximate a first end of said fourth elevating leg, and rotatably connected to a fourth connection pin proximate a second end of said fourth elevating leg, wherein said fourth connection pin is moved along said seventh and eighth guide slots, and a height of said second connection link plate can be user adjusted relative to said base plate;

a second connection lever connecting said third connection pin to said fourth connection pin; and a support mechanism for retaining said first, second, third and fourth link mechanisms, such that said first and second connection link plates remain at a user's adjusted height relative to said base plate.

10. The media cassette as claimed in claim 9, wherein said support mechanism includes:

a first support table positioned on said base plate between said first and second link mechanisms, said first support table having a slanted surface;

a first connection support shaft connected to said first and second elevating legs and engaging said slanted surface of said first support table;

a second support table positioned on said base plate between said third and fourth link mechanisms, said second support table having a slanted surface; and a second connection support shaft connected to said third and fourth elevating legs and engaging said slanted surface of said second support table.

11. The media cassette as claimed in claim 10, wherein said support mechanism further includes:

resilient members connected to said base plate, wherein said resilient members apply a biasing force tending to move said first ends of said first, second, third and fourth elevating legs toward said base plate such that said first and second connection support shafts bear against said slanted surfaces of said first and second support tables, respectively.

12. A media cassette as claimed in claim 11, wherein said first and second support tables are connected together and have at least one slot aperture, through which at least one coupling screw passes to connect said first and second support tables to said base plate, so that said first and second support tables can be attached to said base plate at a user adjustable position.

* * * * *